United States Patent [19]

Rohde

[11] 4,010,551

[45] Mar. 8, 1977

[54] ARRANGEMENT FOR THE TREATMENT, PARTICULARLY THE DRYING, OF PARTICULATE MATTER BY ENTRAINMENT IN A GAS

[75] Inventor: Wolfgang Rohde, Essen, Germany

[73] Assignee: Bergwerksverband GmbH, Essen, Germany

[22] Filed: June 10, 1975

[21] Appl. No.: 585,583

[30] Foreign Application Priority Data

June 10, 1974 Germany ..... 2427932

[52] U.S. Cl. ..... 34/57 R; 302/64; 432/58

[51] Int. Cl.² ..... F26B 17/00

[58] Field of Search ..... 302/64; 138/103, 138; 432/14, 58; 34/10, 57 R, 57 A, 57 B

[56] References Cited

UNITED STATES PATENTS

| | | | |
|---|---|---|---|
| 651,671 | 6/1900 | Schuman | 302/64 |
| 1,050,623 | 1/1913 | Dick | 302/64 |
| 1,597,438 | 8/1926 | Ennis | 302/64 |
| 2,190,565 | 2/1940 | Joyce | 34/57 R |
| 3,309,785 | 3/1967 | King | 34/57 R |

*Primary Examiner*—John J. Camby
*Assistant Examiner*—Larry I. Schwartz
*Attorney, Agent, or Firm*—Michael J. Striker

[57] ABSTRACT

An arrangement is disclosed which is suitable for the treatment of particulate matter entrained by a gas, a preferred application being to the drying of particulate matter. The arrangement includes a treatment zone having an inlet region for the introduction of a stream of particulate matter which is entrained by a gas. Means defining a flow path for the substantially uniform entrainment of the particulate matter by the gas is provided upstream of the inlet region. The means includes a first section having an arcuate part and which communicates with a source of the gas. This first section has an upstream portion of circular cross-section and a downstream portion of rectangular cross-section and includes a region wherein the flow path cross-sectional area decreases in downstream direction. The flow path-defining means further includes a second section of rectangular cross-section communicating with the downstream portion of the first section and also includes a third section arranged intermediate the second section and the inlet region of the treatment zone and which communicates with the second section and the inlet region. The third section comprises an upstream part of rectangular cross-section and a downstream part of circular cross-section and has a region wherein the flow path cross-sectional area increases in downstream direction. Feeding means is provided for feeding particulate matter into the flow path-defining means. The feeding means communicates with the second section of the flow path-defining means. The arrangement makes it possible to achieve a uniform distribution of particulate matter in a treatment zone and is particularly applicable to treatment zones of larger diameter where a uniform distribution of the particulate matter over the cross-section of the zone is often difficult to achieve.

7 Claims, 4 Drawing Figures

SECTION A-A AND B-B

SECTION C-C AND G-G

ARRANGEMENT FOR THE TREATMENT, PARTICULARLY THE DRYING, OF PARTICULATE MATTER BY ENTRAINMENT IN A GAS

BACKGROUND OF THE INVENTION

The invention relates generally to arrangements for the treatment of particulate matter wherein the particulate matter is entrained by a gas for treatment. Of particular interest to the invention are arrangements for the drying of particulate matter, that is, pneumatic conveying dryers.

Pneumatic conveying dryers have already for a long time been used for the drying, and also for the heating, of finely divided, moist particulate materials. Generally, a pneumatic conveying dryer includes a vertically arranged conduit through which a hot gas flows from bottom to top with a relatively high velocity. The material to be dried is fed in at a bottom portion of the conduit, entrained by the gas stream and dried while being carried upwardly through the conduit by the gas stream. The velocity of flow of the hot gas must here lie well above that velocity at which the coarse particles of the particulate material would remain suspended. The drying occurs primarily in the lower and middle regions of the conduit. As a rule, the upper region of the conduit opens into a cyclone which serves for separating the hot particulate material from the gas stream.

It is known to construct such pneumatic conveying dryers with a single stage, that is, with a single conduit for drying. It is further known, however, to construct such pneumatic conveying dryers with two or more stages. Two-stage pneumatic conveying dryers are, for instance, utilized for the thermal treatment of wet coking coal. Here, throughputs of 50 tons per hour have been achieved heretofore.

The gas inlet end of a given vertically arranged drying conduit is generally constructed in the form of a 90° or a 180° elbow. Thus, the hot gas is produced in a horizontally oriented combustion chamber. The gas produced in the combustion chamber must then be conveyed into the single drying conduit constituting the sole stage of a single-stage dryer or, for the case of a two-stage dryer, for instance, into the drying conduit constituting the second stage. Here, the gas inlet end of the drying conduit will be in the form of a 90° elbow. On the other hand, for the case of a two-stage dryer, for example, the gas obtained from the cyclone of the second stage is conveyed vertically downwardly to the entrance of the first stage. Here, a 180° elbow is required in order that the gas obtained from the cyclone of the second stage may enter the drying conduit constituting the first stage.

The introduction of the particulate material into the lower region of the vertical conduit occurs immediately downstream of the elbow and, for the case of moist materials, the feeding of the particulate material has heretofore been accomplished by free fall or by means of rotating impellers. The latter are particularly advantageously used when the particulate material to be fed in is moist and consists of particles which tend to adhere to one another. For the feeding of dry, readily fluidized particulate materials, it has also become known to use vibrating beds of particulate material which surround the cross-section of the conduit in the form of an annulus. The latter type of particulate material is also satisfactorily blown into the drying conduit by means of gas streams.

A disadvantage of the prior art resides in that the known arrangements for the feeding of moist and difficult-to-fluidize particulate materials can be used only when the diameter of the drying conduit is one meter or less. The reason is that the finely divided particulate material can be uniformly distributed over the entire conduit cross-section during feeding only when the conduit diameter is small. A uniform distribution of the particulate material over the conduit cross-section is, however, of importance since it is only with such a uniform distribution that a homogeneous transport and drying of the material along its path of travel can be insured.

To illustrate one of the considerations involved, it is pointed out that for smaller apparatus having, for example, a throughput capacity of 10 tons per hour, the requisite conduit diameter is of the order of 300 to 400 millimeters so that a uniform distribution of the material poses no difficulties. However, as just indicated, this is not the case for conduit diameters exceeding one meter. Since the maximum throughput capacity achievable for conduit diameters of less than one meter is 50 tons per hour, it will be appreciated that the prior art feeding means poses a rather severe restriction on the throughput capacities which may be obtained.

SUMMARY OF THE INVENTION

A general object of the invention is to provide a novel arrangement of the type wherein particulate material is entrained by a gas for treatment.

Another object of the invention is to provide an arrangement of the type wherein particulate material is entrained by a gas for treatment which enables a substantially uniform distribution of moist and difficult-to-fluidize material over the cross-section of the treatment zone to be achieved even when the diameter of the latter exceeds one meter.

A further object of the invention is to provide an arrangement of the type wherein particulate material is entrained by a gas for treatment which enables higher throughput capacities than heretofore be achieved.

An additional object of the invention is to provide a feeding means for pneumatic conveying dryers with which a uniform material distribution over the cross-section of the drying conduits may be achieved even for conduit diameters in excess of one meter.

These objects, as well as others which will become apparent, are achieved in accordance with the invention. According to one aspect of the invention, there is provided an arrangement for the treatment of particulate matter which comprises a treatment zone having an inlet region for the introduction of a stream of particulate matter which is entrained by a gas. Means upstream of the inlet region defines a flow path for the substantially uniform entrainment of particulate matter by a gas. The flow path-defining means includes a first section (hereinafter also referred to as an elbow section or elbow) having at least one arcuate part and which is arranged for communication with a source of gas. The first or elbow section comprises an upstream portion of substantially circular cross-section and a downstream portion of substantially rectangular cross-section and has a region wherein the flow path cross-section decreases in downstream direction. The flow path-defining means further includes a second section (hereinafter also referred to as a channel section or channel) of substantially rectangular cross-section communicating with the downstream portion of the first or elbow section. In addition, the flow path-defining means includes a third section (hereinafter also referred to as a diffuser section or diffuser) arranged intermediate the second or channel section and the inlet region of the treatment zone and which communicates with this inlet region and the second or channel section. The third or diffuser section comprises an upstream part of substantially rectangular cross-section and a downstream part of substantially circular cross-section and has a region wherein the flow path cross-section increases in downstream direction. Admitting means communicates with the second or channel section for introducing into the latter particulate matter to be entrained by a gas flowing from the first or elbow section towards the inlet region of the treatment zone.

A preferred application of the invention resides in pneumatic conveying dryers, that is, in arrangements of the type wherein the treatment zone serves as a drying zone and, concomitantly, as a heating zone if desired. Hence, for the sake of simplification, the description herein will be primarily with reference to pneumatic conveying dryers.

An important feature of the invention relates to a feeding means for finely divided particulate material, particularly moist particulate material, for use with pneumatic conveying dryers, especially those which include a drying zone or conduit having a diameter in excess of one meter. An advantageous application of the invention is to moist, finely divided coal.

It is pointed out here that, although the concepts of the invention are directed primarily to moist, difficult-to-fluidize particulate materials, the concepts of the invention are not restricted exclusively to such particulate materials. For instance, the concepts of the invention may also apply to dry, readily fluidized particulate materials.

As has already been indicated, a feeding means in accordance with the invention includes an elbow section which converges in downstream direction and the cross-sectional configuration of which changes from substantially circular or round to substantially rectangular. Favorably, the elbow section has an outer contour which is in the form of an arc of a circle, that is, it is favorable when the elbow section bends in a manner such that the outside of the bend defines a contour which is in the form of an arc of a circle. A channel section of substantially rectangular cross-sectional configuration, and which is advantageously rectangular in construction, is arranged downstream of the elbow section. An admitting or charging device for particulate material which may, for instance, comprise a trough or a chute, communicates with the channel section. Preferably, the arrangement is such that one of the longer or wider sides of the channel section is located so as to blend into the outer contour of the elbow section and that the charging device communicates with this side of the channel section. Downstream of the channel section there is arranged a diffuser section which, as indicated previously, diverges in downstream direction and has a cross-sectional configuration which changes from substantially rectangular to substantially round or circular. According to a preferred embodiment of the invention, the diameter of the outlet end of the diffuser section is substantially equal to the diameter of the inlet end of the elbow section. Advantageously, the axes of the elbow section, the channel section, the charging device and the diffuser section all lie in the same plane.

To provide a fuller appreciation of the invention, it is pointed out that it has been found that larger throughput capacities are achieved not so much as a result of higher gas velocities or longer pneumatic drying conduits but, rather, essentially only by enlarging the cross-section of the drying conduit. As a first approximation, a ten-fold increase in throughput capacity requires an enlargement of the conduit diameter by a factor of the square root of 10. From the earlier illustration where it was indicated that a throughput capacity of 10 tons per hour requires a conduit diameter of about 300 to 400 millimeters, it will be apparent that conduit diameters in excess of one meter are necessary for pneumatic conveying dryers having, for instance, a capacity of 100 tons per hour. It is particularly here that the present invention finds utility in that, by virtue of the novel feeding means provided thereby, it enables a substantially uniform material distribution over the large cross-section to be achieved.

By means of the construction, according to the invention of the feeding portion of a pneumatic conveying conduit, there is achieved the result that the particulate material is fed into the conduit in a stream having an equalized, substantially homogeneous velocity profile. Such feeding of the particulate material may be insured, on the one hand, by the acceleration which occurs and, on the other hand, by adjustment of the contour of the elbow section to the natural pattern of the flow. So-called "dead water regions", as well as the appearance of reverse flow, may thereby be avoided. The equalized velocity profile in the feeding cross-section is achieved when the flow is accelerated by a factor of about 1.2 to about 1.5. Naturally, the same flow effect may also, for example, be achieved with a two-fold acceleration. However, from a technical point of view, such a high degree of acceleration has little purpose. The reason is that, as a result, the pressure loss is increased excessively and, moreover, the subsequent deceleration of the flow in a manner substantially free from non-laminar or eddy effects becomes more difficult. The actual charging of the material occurs in the advantageously rectangular channel section with the arrangement favorably being such that the sides of the rectangular profile of the channel section which extends transversely to the charging conduit are larger than the other sides of the rectangular profile.

The acceleration and deceleration regions are preferably constructed in a Venturi-like manner in order to avoid non-laminar or eddy effects and in order to insure that the pressure loss in the gas stream remains as low as possible. The calculations for, and the construction of, the Venturi-like passage may be carried out in accordance with the known rules of aerodynamics.

As has already been mentioned, the inlet or charging opening for the particulate material is favorably provided in one of the wider or longer sides of the advantageously rectangular channel section. This design according to the invention has the advantage that the particulate material may be conveyed to the charging opening via a wider side of the channel section in an already uniform manner and in the form of a layer having a constant thickness and then need be fed into the small channel section only by means of a small impulse such as, for instance, that imparted by rotating impellers. It will be appreciated that it is considerably easier to obtain a uniform solids distribution over a small channel section than over a broad one, especially when the rotating impellers travel at a constant rotational speed and can, therefore, naturally impart only a predetermined impulse to the particulate material. Of course, if it is desired to obtain a finer correspondence between the velocity of the gas stream and the impulse imparted by the impellers, then the latter may be driven with variable rotational speed. It will be self-understood that the impulse should not be increased to such an extent that the particulate material is flung against the side of the channel section located opposite that provided with the charging opening.

Good results are obtained when the length ratio between the sides of the advantageously rectangular channel section lies in the range of about 3:1 to 2:1. It is particularly advantageous when this length ratio is about 2.66:1.

According to a further embodiment of the invention, the advantageously rectangular channel section is constructed so as to have rounded corners, that is, is formed so as to have an approximately oval configuration. In this manner, dead flow regions in the corners may be avoided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 1:
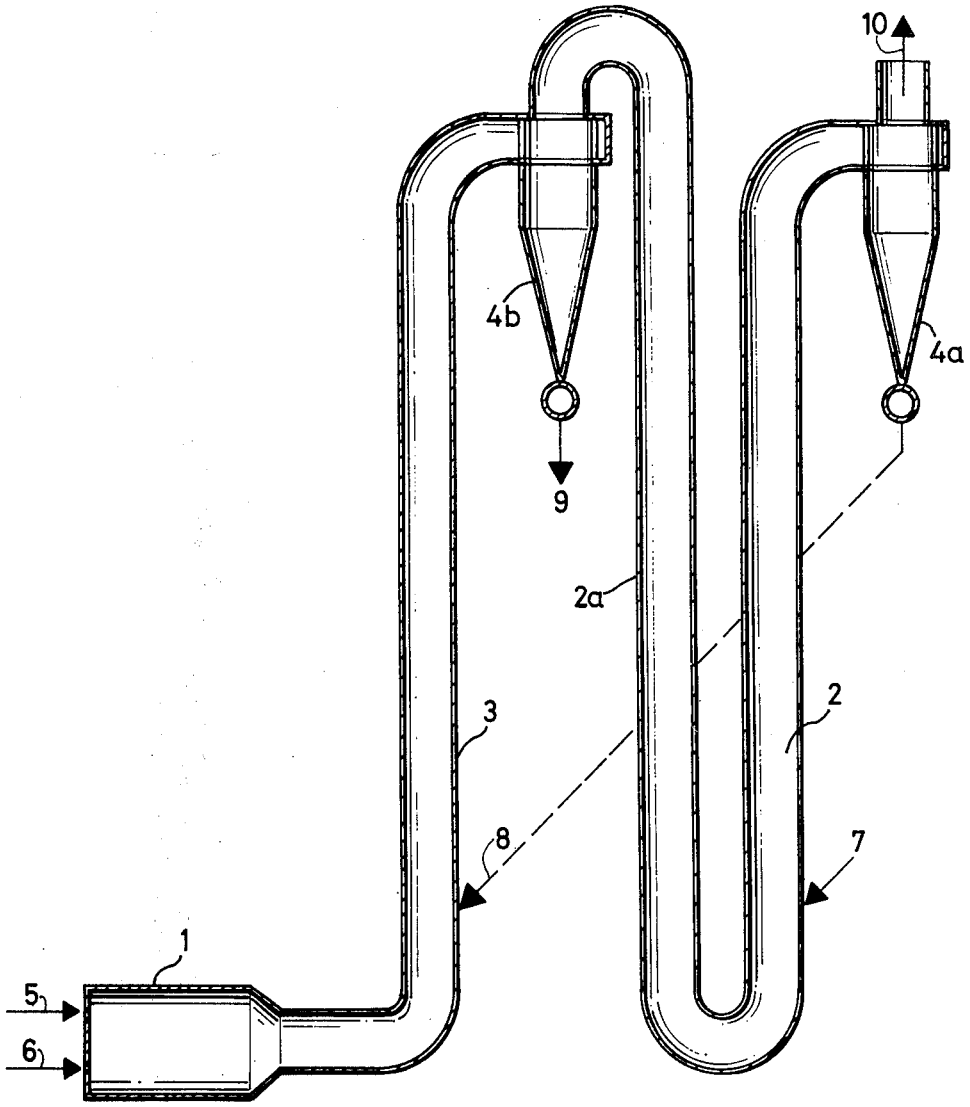
FIG. 1 schematically represents a two-stage pneumatic conveying dryer according to the prior art.

DESCRIPTION OF THE PREFERRED EMBODIMENTS:

Referring now to the drawing, it is pointed out that FIG. 1 shows a two-stage pneumatic conveying dryer. Such a dryer may, for example, be used for the drying of moist coal. The dryer of FIG. 1 is constructed in accordance with the prior art and is presented here to illustrate the principle of the two-stage pneumatic conveying dryer and to provide a better basis for understanding the applicability of the invention.

The dryer of FIG. 1 includes a combustion chamber 1 which is supplied with fuel as indicated by the arrow 5 and is also supplied with air as indicated by the arrow 6. The combustion gases generated in the chamber 1 serve as the medium for entraining and conveying the particulate material to be dried in the dryer.

A vertically arranged conduit 3 communicates with the chamber 1 and it may be seen that the combustion gases generated in the latter must travel around a 90° bend in order to enter the conduit 3. The conduit 3 defines a drying zone which constitutes the second stage of the dryer. The particulate material to be entrained by the combustion gases and conveyed upwardly through the conduit 3 for drying is admitted into the conduit 3 as indicated by the arrow 8, that is, is admitted into the conduit 3 in the region of the lower end thereof. A cyclone **4*b* is arranged in the region of the upper end of the conduit 3 and serves to separate the dried particulate material from the combustion gases. The dried particulate material is withdrawn from the cyclone 4*b* via an outlet 9.**

The combustion gases leave the cyclone **4*b* through the upper end thereof and enter a conduit 2*a* through which they travel downwardly. At the bottom of the conduits 2*a*, the direction of flow of the gases is changed by 180° and the gases then enter another vertically arranged conduit 2.** The latter defines a drying zone which constitutes the first stage of the dryer.

The particulate material to be dried in the conduit 2 is admitted therein as indicated by the arrow 7, that is, the particulate material is introduced into the conduit 2 in the region of the lower end thereof. The gases flowing into the conduit 2 entrain this particulate material and convey it upwardly through the conduit 2 thereby subjecting the particulate material to a drying action.

A cyclone **4*a* is arranged in the region of the upper end of the conduit 2 and serves to separate the gases and the particulate material. The particulate material leaves the cyclone 4*a* via the lower end thereof and, as indicated by the arrow 8, is admitted into the conduit 3, that is, the second stage of the dryer. The gases are withdrawn from the cyclone 4*a* through the upper end thereof as indicated by the arrow 10.**

In operation, then, particulate material to be dried is admitted into the conduit 2 as indicated by the arrow 7. In the conduit 2, the particulate material is subjected to an initial drying action or, in other words, is pre-dried. The pre-dried material is recovered from the cyclone **4*a* and is then admitted into the conduit 3 for further drying. The finally dried material is withdrawn through the outlet 9 of the cyclone 4*b***.

A dryer such as illustrated can operate satisfactorily so long as the diameters and, concomitantly, the cross-sectional areas, of the usually circular conduits 2 and 3 are relatively small. However, when the diameters of the conduits 2 and 3 become large, difficulties arise. These are associated with the fact that a uniform distribution of the particulate material over the cross-sections of the conduits 2 and 3 becomes very difficult, if not impossible, to achieve when the cross-sectional areas are large. Since a uniform distribution of the particulate material over the cross-sections of the conduits 2 and 3 is an important factor in obtaining a good drying action, it may be seen that the achievement of such a uniform distribution is a desirable goal.

Usually, a uniform distribution of the particulate material cannot be achieved according to the prior art when the diameters of the conduits 2 and 3 exceeds approximately one meter. It is particularly in such instances, that is, where the diameters or cross-sectional areas of the conduits 2 and 3 are large, that the invention finds applicability. The invention intends to provide a means whereby a substantially uniform distribution of particulate material over the cross-sections of conduits such as the conduits 2 and 3 may be obtained even when the diameters of the conduits are large. The importance of achieving a substantially uniform distribution of the particulate material over the cross-sections of large conduits resides in that large conduits are necessary in order to obtain high throughput capacities. Thus, as indicated earlier, a primary factor in achieving an increased throughput capacity is an increased conduit cross-section.

The invention is particularly concerned with those portions of an arrangement for treating particulate material corresponding to the vicinity of the 90° bend between the combustion chamber 1 and the conduit 3 of FIG. 1 and the vicinity of the 180° bend between the conduits 2*a* and 2 of FIG. 1. The principles of the invention will here be illustrated using a 90° bend as exemplary.

Figure 2:
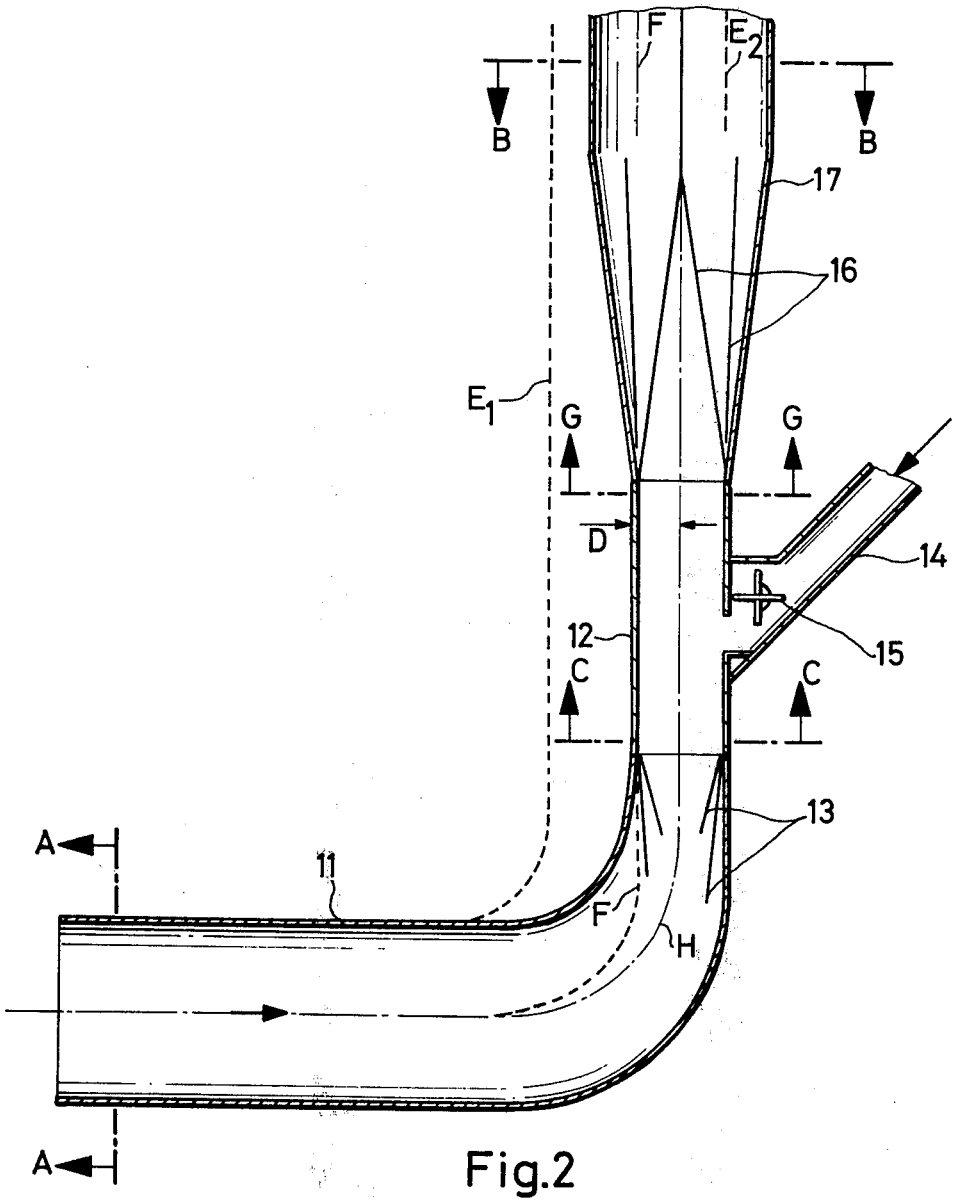
FIG. 2 shows one embodiment of the invention and illustrates the principles of the invention.

In this connection, reference may be had to FIG. 2 which illustrates an embodiment of the invention. In this Figure, the numeral 11 identifies an elbow section which communicates with a source of gas, this source not being shown here for the sake of clarity. The source may be a combustion chamber, such as the chamber 1 of FIG. 1, wherein combustion gases or flue gases having a temperature of 550° C, for instance, are generated by the combustion of a fuel gas in the presence of air. In any event, gas from the source enters the elbow section 11 in a direction from left to right as seen in FIG. 2.

Figure 2A:
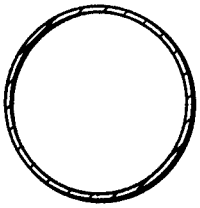
FIGS. 2*a* and 2*b* are cross-sections of various locations of the embodiment of FIG. 2.
Figure 2B:
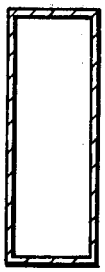

The upstream part of the elbow section 11 where the gas enters the same has a circular cross-section as indicated by a section taken in the plane A—A and shown in FIG. 2*a*. The elbow section 11 bends through an angle of 90° and has a rectangular cross-section at the downstream end thereof as indicated by a section taken in the plane C—C and shown in FIG. 2*b*. Thus, it will be appreciated that the elbow section 11 includes a region wherein the cross-sectional configuration thereof undergoes a transition from circular to rectangular. This region is identified by the reference numeral 13. It will be further seen that the elbow section 11 converges or becomes narrower in downstream direction. This is here achieved in that the inner contour of the elbow section 11, that is, the curved portion of the elbow section 11 having a smaller radius, is displaced towards the outer contour of the elbow section 11, that is, the curved portion of the elbow section 11 having a larger radius. In the illustrated embodiment, the cross-sectional area in the plane C—C is smaller than that in the plane A—A by a factor of 1.2.

Downstream of the elbow section 11, there is arranged a channel section 12 of rectangular configuration which extends from the plane C—C to the plane indicated at G—G. The cross-sectional configuration in the plane G—G may be visualized from FIG. 2*b* since the instant embodiment provides for the cross-sectional configurations in the planes C—C and G—G to be identical. In the present instance, the length of the longer and shorter sides of the channel section 12 are assumed to be in the ratio of 2.1:1.

An opening is provided in one of the sides of the channel section 12 for the introduction of particulate material into the hot gas stream flowing from the elbow section 11 into the channel section 12. This gas stream is accelerated by a factor of 1.2 due to the reduction in cross-sectional area which occurs between the plane A—A and the plane C—C. It may be seen that the inlet opening is provided in one of the wider sides of the channel section 12 and that the construction is such that this side of the channel section 12 is arranged to merge into the outer contour of the elbow section 11.

A charging arrangement is provided for charging the particulate material to the channel section 12. The charging arrangement here includes a chute 14 which communicates with the inlet opening provided in the side of the channel section 12. The chute 14 may, for instance, be in the form of a vibratory chute. An impeller 15 is arranged in the region of the inlet opening for ejecting the particulate material into the channel section 12.

It is pertinent to contemplate the particular construction of that portion, namely, the sections 11 and 12, of the feed conduit according to the invention which has been detailed to this point. This may best be done by considering the contour represented by the dashed line identified $E_1$, the contour represented by the dashed line identified $E_2$, the axis identified by F and the axis identified by H. The contour $E_1$ represents the inner contour of a prior-art feed conduit, the contour $E_2$ represents the outer contour of a prior-art feed conduit, the axis F represents the axis of a prior-art feed conduit and the axis H represents the axis of the feed conduit according to the invention. It may be seen that the outer contour of the feed conduit according to the invention extends in substantially the same manner as the prior-art outer contour $E_2$ up to the plane G—G, that is, the extension of the line identified by $E_2$ will blend into the outer contour of the feed conduit according to the invention at the plane G—G. On the other hand, the inner contour of the feed conduit according to the invention already starts to depart from the prior art inner contour $E_1$ in the vicinity of the beginning of the curvature of the section 11.

In all cases, it is preferred for the prior-art outer radius to be maintained for the feed conduit according to the invention regardless of the radius which is selected for the elbow section 11. In contrast, the inner contour of the elbow section 11 is greatly changed as opposed to the prior art. This becomes most evident from a consideration of the axis F of the prior-art feed conduit and the axis H of the feed conduit according to the invention. Thus, it may be seen that, from the vicinity of the beginning of the elbow section 11, the axis H of the feed conduit according to the invention is shifted away from the axis F of the prior-art feed conduit towards the outer contour. This continues until the axis H of the feed conduit according to the invention departs from the axis F of the known conduit for pneumatic conveying dryers by the dimension D.

It is now pointed out that a diffuser section 17 is arranged downstream of the channel section 12. The diffuser section 17 is of rectangular cross-section at the upstream end thereof, that is, at the end thereof located adjacent the plane G—G. At its downstream end, the diffuser section 17 has a circular cross-section. This is indicated by the plane B—B and the cross-section of the diffuser section 17 may be visualized from FIG. 2*a* since, in the illustrated embodiment, the cross-section of the diffuser section 17 in the plane B—B corresponds to the cross-section of the elbow section 11 in the plane A—A. It will be understood, however, that the axis of the diffuser section 17 is shifted by the dimension D from the axis of the elbow section 11 at the plane A—A, that is, the axis of the diffuser section 17 is shifted by the dimension D from the axis of a conduit conforming to the contours $E_1$ and $E_2$.

It will be appreciated that the diffuser section 17 includes a region wherein a transition occurs from a rectangular cross-section to a circular cross-section. This region is identified by the reference numeral 16 in FIG. 2.

In the diffuser section 17, the flowing gas stream is decelerated to the same velocity which occurs at the plane A—A. The deceleration is preferably so gradual that non-laminar or eddy effects do not arise. The known rules of aerodynamics apply to the design of the diffuser section 17. The diffuser section 17 opens into a conduit such as the conduit 3 of FIG. 1 which has, however, not been illustrated here for the sake of simplicity.

The achievement and operation of the invention are readily apparent. A gas stream flowing through the elbow section 11 towards the channel section 12 is accelerated upstream of the inlet opening for the particulate material due to the reduction in flow path cross-section which occurs. The accelerated gas stream then entrains the particulate material in the channel section 12. On the one hand, a substantially uniform entrainment of the particulate material may be realized since the flow path cross-section at the location where the particulate material becomes entrained is reduced. On the other hand, a substantially uniform entrainment of the particulate material may be simplified by providing for the particulate material to be introduced into the channel section 12 via a wider side thereof. Thus, in this manner, the distance over which the particulate material must be ejected is decreased since, rather than corresponding to the width of the wider sides of the channel section 12, this distance now corresponds to the width of the narrower sides of the channel section 12. The stream of particulate material and gas thus obtained is then favorably decelerated and thereafter admitted into a suitable treatment zone.

It will be understood that each of the elements described above, or two or more together, may also find a useful application in other types of arrangements differing from the types described above.

While the invention has been illustrated and described as embodied in feeding means for a pneumatic conveying dryer, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A pneumatic conveying dryer, comprising a drying zone having an inlet region for the introduction of a stream of particulate matter which is entrained by a gas; means upstream of said inlet region defining a flow path for the substantially uniform entrainment of particulate matter by a gas, said means including a first section having at least one arcuate part and which is arranged for communication with a source of gas, and said first section comprising an upstream portion of substantially circular cross-section and a downstream end of substantially rectangular cross-section and having a region wherein the flow path cross-section decreases in downstream direction, said means further including a second section of substantially rectangular transverse cross-section communicating with said downstream portion, said second section having a pair of first sides and a pair of second shorter sides, said second section having in a longitudinal cross-section across said pair of first sides two parallel straight boundary lines spaced transversely from each other, and said arcuate part of said first section having in said longitudinal cross-section two curved boundary lines, each of said straight boundary lines being tangential to a respective one of said curved boundary lines, and said means also including a third section arranged intermediate said second section and said inlet region and communicating therewith, said third section comprising an upstream end of substantially rectangular cross-section and a downstream part of substantially circular cross-section and having a region wherein the flow path cross-section increases in downstream direction; and an admitting arrangement communicating with one of said first sides of said second section for introducing into said second section particulate matter to be entrained by a gas flowing from said first section towards said inlet region.

2. A dryer as defined in claim 1, said first section having an inlet end for the introduction therein of a gas, and said third section having an outlet end adjacent said inlet region; and wherein the flow path cross-section at said inlet end substantially equals that at said outlet end.

3. A dryer as defined in claim 1, wherein said one first side is arranged so as to merge into the outer contour of said first section.

4. A dryer as defined in claim 1, said second section having a pair of first sides and a pair of shorter second sides; and wherein the ratio of the length of either of said first sides to the length of either of said second sides is between about 2:1 and 3:1.

5. A dryer as defined in claim 4, wherein said ratio is substantially 2.66:1.

6. A dryer as defined in claim 1, wherein said drying zone is of substantially circular cross-section and has a diameter in excess of 1 meter.

7. An arrangement for treatment of particulate matter comprising a treatment zone having an inlet region for the introduction of a stream of particulate matter which is entrained by a gas; means upstream of said inlet region defining a flow path for the substantially uniform entrainment of particulate matter by a gas, said means including a first section having at least one arcuate part and which is arranged for communication with a source of gas, and said first section comprising an upstream portion of substantially circular cross-section and a downstream end of substantially rectangular cross-section and having a region wherein the flow path cross-section decreases in downstream direction, said means further including a second section of substantially rectangular transverse cross-section communicating with said downstream portion, said second section having a pair of first sides and a pair of second shorter sides, said second section having in a longitudinal cross-section across said pair of first sides two parallel straight boundary lines spaced transversely from each other, and said arcuate part of said first section having in said longitudinal cross-section two curved boundary lines, each of said straight boundary lines being tangential to a respective one of said curved boundary lines, and said means also including a third section arranged intermediate said second section and said inlet region and communicating therewith, said third section comprising an upstream end of substantially rectangular cross-section and a downstream part of substantially circular cross-section and having a region wherein the flow path cross-section increases in downstream direction; and an admitting means communicating with one of said first sides of said second section for introducing into said second section particulate matter to be entrained by a gas flowing from said first section towards said inlet region.

* * * * *

UNITED STATES PATENT AND TRADEMARK OFFICE

CERTIFICATE OF CORRECTION

PATENT NO. : 4,010,551

DATED : March 8, 1977

INVENTOR(S) : Wolfgang Rohde

It is certified that error appears in the above-identified patent and that said Letters Patent are hereby corrected as shown below:

On the Title page

In the heading, the name and address of the second assignee should be added, and read -- Didier Engineering GmbH, Essen, Germany --.

Signed and Sealed this

*Twenty-first* Day of *September 1982*

[SEAL]

*Attest:*

GERALD J. MOSSINGHOFF

*Attesting Officer*

*Commissioner of Patents and Trademarks*